US006067714A

United States Patent [19]

Taylor et al.

[11] Patent Number: 6,067,714

[45] Date of Patent: May 30, 2000

[54] TURBO CLEANING ILLUMINATED PERSONAL GROOMER

[75] Inventors: Charles E. Taylor, Sebastapol; Richard J. Thalheimer, San Francisco, both of Calif.

[73] Assignee: Sharper Image Corporation, San Francisco, Calif.

[21] Appl. No.: 09/165,247

[22] Filed: Oct. 1, 1998

Related U.S. Application Data

[60] Provisional application No. 60/060,905, Oct. 3, 1997.

[51] Int. Cl.[7] ..... B26B 19/38

[52] U.S. Cl. ..... 30/29.5; 30/41.5; 83/520

[58] Field of Search ..... 30/29.5, 41.5, 30/43.6; 83/520

[56] References Cited

U.S. PATENT DOCUMENTS

| | | |
|---|---|---|
| 3,731,379 | 5/1973 | Williams . |
| 3,925,888 | 12/1975 | Bozsanyi . |
| 4,958,432 | 9/1990 | Marshall . |
| 5,012,576 | 5/1991 | Johannesson . |

FOREIGN PATENT DOCUMENTS

| | | | |
|---|---|---|---|
| 2699448 | 6/1994 | France | 83/520 |

*Primary Examiner*—Douglas O. Watts

*Attorney, Agent, or Firm*—Flehr Hohbach Test Albritton & Herbert LLP

[57] ABSTRACT

A personal groomer includes a hand-holdable housing within which is disposed a battery operated motor coupled to a cutting head assembly that protrudes at least partially from a distal end of the housing. An impeller fin assembly is attached to a lower portion of the cutting head assembly for rotation therewith when the motor is energized. Preferably the lower portion of the cutting head assembly and the impeller fin assembly are surrounded by a thimble-shaped member defining sidewall vents and having an opening in its upper surface, through which a distal portion of the cutting head assembly protrudes. A light source is mounted in the housing so as to focus light on hairs to be cut with the groomer. The groomer is cleaned by submerging the distal end of the housing assembly in water and energizing the motor. The resultant impeller fin rotation draws water into the cutting head assembly, and expels the water along with cut hairs and any other debris out the vents in the thimble-shaped member. A housing-mounted switch, preferably a pressure switch or a toggling switch, permits user activation of the personal groomer.

22 Claims, 3 Drawing Sheets

TURBO CLEANING ILLUMINATED PERSONAL GROOMER

RELATION TO PREVIOUSLY FILED APPLICATION

Priority is claimed to applicants' Provisional patent application, Ser. No. 60/060,905 filed Oct. 3, 1997.

FIELD OF THE INVENTION

This invention relates to personal groomers, and more specifically to personal groomers with self-contained illumination and improved self-cleaning characteristics.

BACKGROUND OF THE INVENTION

A personal groomer is typically a lipstick-shaped device whose distal tip is inserted into a nostril or ear, for the purpose of trimming away nose or ear hair. The distal tip of the groomer contains a hair cutting assembly that is operated by a small battery operated motor within the grooming device. As a rotary metal cutting blade within the hair cutting assembly rotates, hairs are trimmed.

Unfortunately, ear and nasal cavities are dark, and it can be difficult for a user to see what he or she is actually doing. Further, cut hairs and dust can enter the groomer and eventually clog the cutting assembly. Unfortunately, it can be difficult and messy to remove cut hairs from conventional personal groomers. Typically the groomer is operated in open air, with the hope that the various cut hairs and any other debris will be cleared from the groomer. Unfortunately, complete cleaning often requires careful disassembly of the groomer, and the use of a toothpick, brush, or air hose. Thus, there is a need for a personal groomer with self-contained lighting and provision for rapid and thorough self-cleaning.

The present invention provides such a personal groomer.

SUMMARY OF THE PRESENT INVENTION

A self-contained hand-holdable personal groomer includes a battery, a DC motor, an illumination source, a cutting head assembly, and one or more self-cleaning turbo fins. The cutting head assembly comprises a stationary outer set of curved blades, and internal motor-driven rotating blades having essentially constant body width, a 90° curve. The blades are attached at their bases to a rotatory base member that is rotated by the DC motor when it is energized. The blades may be metal, ceramic, or other material, and comprise at least two blades. The distal portion of the cutting head assembly protrudes through an opening in the top of a stationary thimble-shaped member having vents in its sidewalls.

A rotatable member having one or more impeller fins is disposed within the thimble-shaped member, coaxially and external to the cutting head assembly. When the motor is energized, the impeller fin(s) rotate, drawing air into the cutting. However, during cleaning, at least the distal portion of the cutting head assembly end is immersed in water and the groomer is turned-on. Impeller blade rotation now draws a flow of water into the cutting head assembly, into the thimble-shaped member, and out through the vent openings. In the process, cut hairs, dust, and other debris within the cutting head assembly or within the thimble-shaped member are forcibly washed out of the groomer. As an alternative to a plurality of turbo fins, a single pump vane or fin that spirals 360° around a central hub may instead be used to draw the flow of water into the cutting head assembly.

An incandescent or an LED light source is provided to illuminate the nose or ear region to be groomed. A light weight version of the groomer uses a 1.5 VDC battery source and an incandescent light source, while a heavier duty version uses at least 3.0 VDC and an LED light source. A preferably pressure or a toggling-mode switch permits a user to energize the groomer.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1:
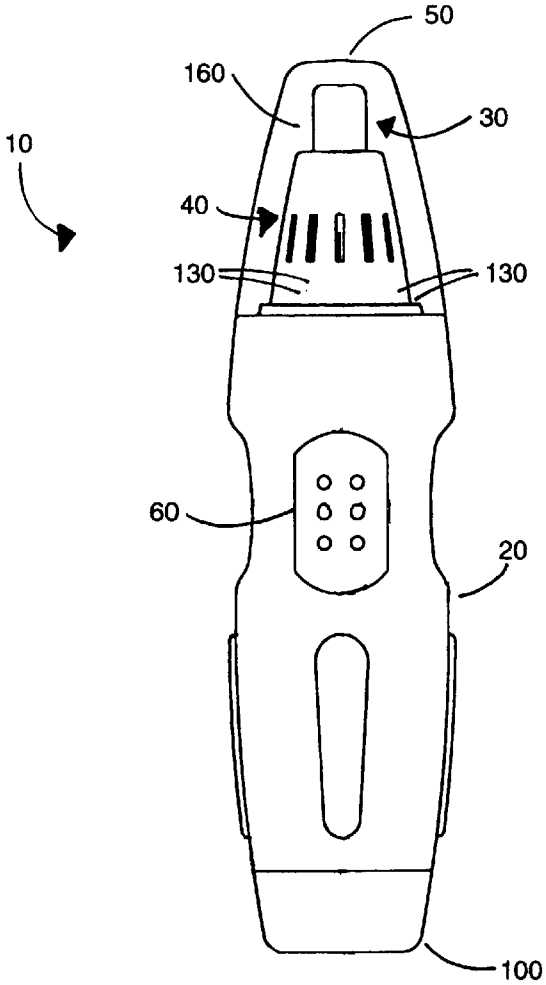
FIG. 1 is a perspective view of the present invention.

FIG. 1 depicts a personal groomer 10 as comprising a body housing 20, a hair cutting head assembly 30, a vented thimble-shaped member 40 that surrounds the lower portion of assembly 30, and a removable protective cap 50. Cap 50 is removed when the groomer is in use, and protects the cutting head assembly when placed on body housing 20, as shown.

Within the housing is a battery and a motor that drives assembly 30, ON-OFF operation of groomer 10 being controlled by a pressure or toggle switch 60. As will be described, attached to the rotational portion of assembly 30 is a rotating impeller finned member 90 (see FIGS. 2 and 4) that is used to clean groomer 10. Groomer 10 is sized to be held comfortably in a user's hand. As such, groomer 10 will be perhaps 13 cm in length and perhaps 3 cm in diameter, although other dimensions may of course be used.

Figure 2:
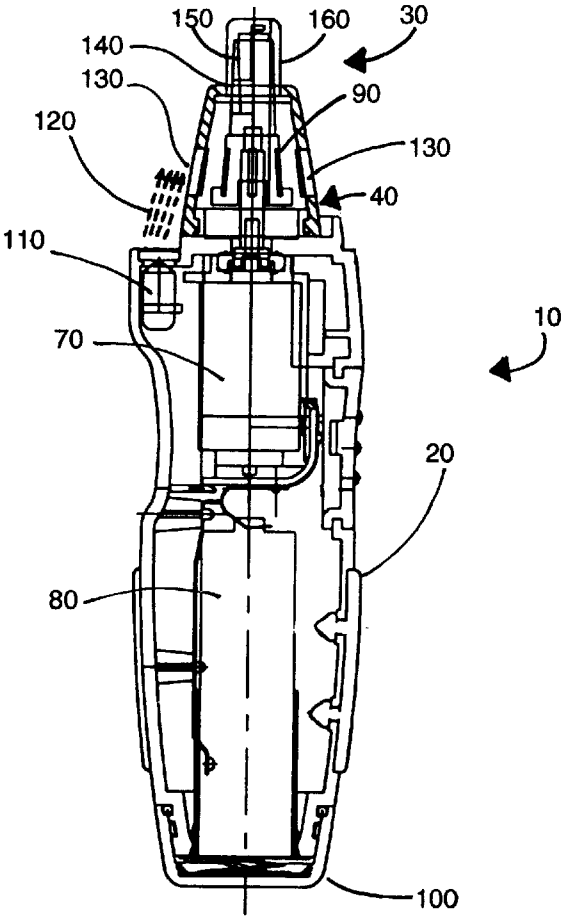
FIG. 2 is a cross-section view of the present invention.

FIG. 2 depicts DC motor 70, which is powered by a battery 80 via switch 60. In the preferred embodiment, motor 70 is a micro-model manufactured by Mabuchi Company of Japan. As will be described, activating switch 60 causes battery 80 to energize motor 70. The rotary action of motor 70 rotates the cutting blade portion of the cutting head assembly, and also rotates impeller finned member 90, which is used to enhance self-cleaning of the groomer.

Access to battery 80 is provided by a removable battery compartment cap 100 that can screw, snap, or otherwise attach to housing 20. Preferably housing 20 and battery cap 100 are fabricated from a smooth finish plastic, injection moldable ABS type material, for example, and protective cap 50 is a transparent plastic. Of course other materials could be used to fabricate these components.

To assist the user, groomer 10 includes an illumination source 110, whose emanations (e.g., rays 120) are aimed at the target nose or ear hairs that will be cut by cutting head assembly 30. In practice, if battery 80 is 1.5 VDC, light source 110 will be an incandescent lamp. However, if battery 80 is greater than 1.5 VDC, e.g., perhaps 3 VDC, achieved by series-connecting smaller voltage cells, then light source 110 may be a super bright, preferably amber colored 3 mm diameter light emitting diode ("LED").

FIG. 2 shows the relationship between cutting head assembly 30, and partially surrounding stationary thimble-shaped member 40 that includes vents 130 in its sidewalls, and a through opening 140 in its upper surface. The upper portion of cutting head assembly 30 protrudes through opening 140 in vented member 40, which preferably is an opaque plastic material.

Figure 3B:
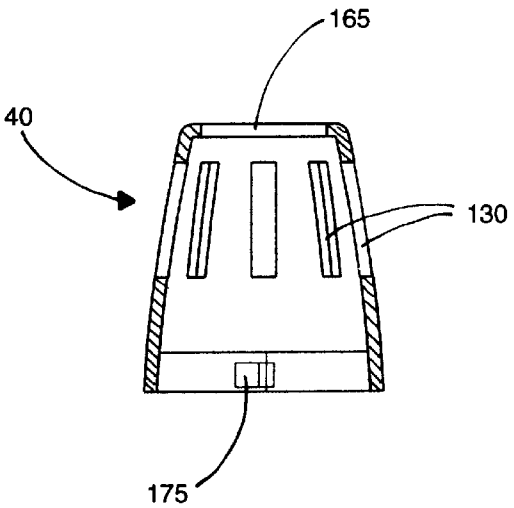
FIG. 3B is a partial cutaway view depicting a vented thimble-shaped member used with a cutting head assembly, according to the present invention.
Figure 3A:
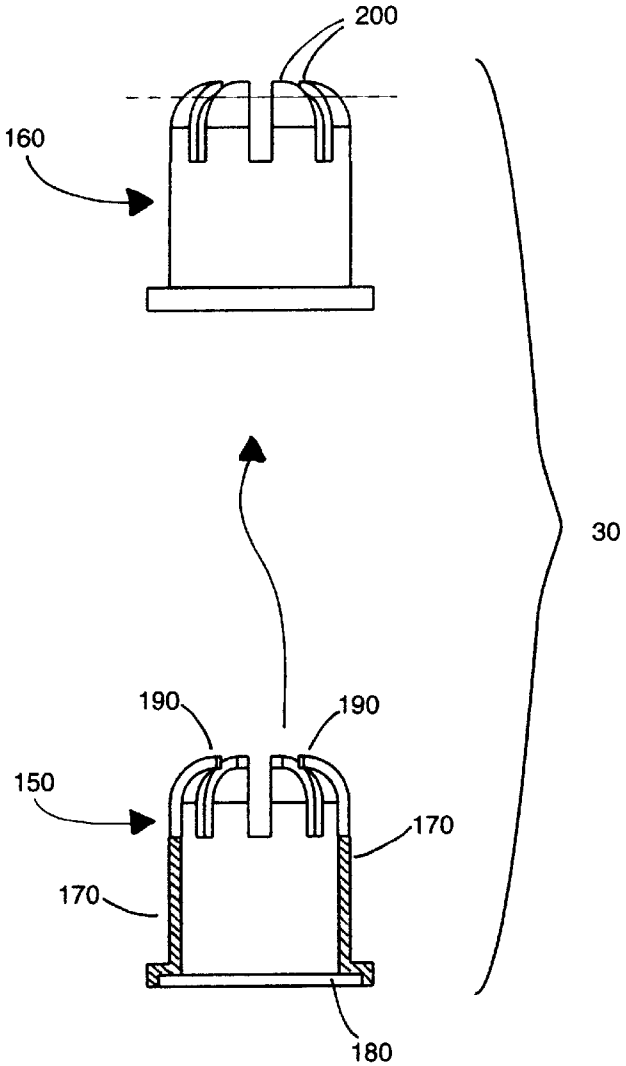
FIG. 3A is an exploded view of a cutting head assembly, according to the present invention.

As shown in exploded or pulled-apart FIG. 3A, cutting head assembly 30 includes a rotary blade set 150 that is base-driven by motor 70, and a coaxially disposed stationary outer cutting member 160 that surrounds blade set 150. FIG. 3A is exploded in that rotary blade set 150 fits coaxially within stationary outer member 160, as suggested by the curved arrow. Normally, the uppermost surface of the blades in set 150 will be disposed at approximately the height of the phantom horizontal line shown in FIG. 3A.

FIG. 3A depicts rotary blade set 150 in sectional cross-section, for ease of understanding. Blade set 150 comprises at least two blades 170 that are joined at their base to a common rotatable base element 180 that is rotated by motor 70. While FIG. 3A depicts only two blades 170, three or more blades may instead be used. The distal portions 190 of blades 170 curve approximately 90° towards a center axis of assembly 30, as shown. The forward direction moving curved and horizontal distal portion of the blades are sharpened. User hair is cut by the sharpened blade edges compressing the hairs against curved castellation-like projections 200 of stationary outer member 160. Blades 170 may be stainless steel, ceramic, or other materials. In practice, maintaining manufacturing tolerances is simplified with ceramic blades, and a greater number of ceramic blades may be accommodated than if stainless steel blades were used. Cut hair typically falls into cutting head assembly 30 and/or the space within vented member 40, from where it may be cleaned as described later herein.

FIG. 3B is a partial cutaway view of thimble shaped member 40. Stationary member 40 includes sidewall vents 130, and has a top opening 165 through which the distal end of stationary member 160 protrudes and preferably twist-locks into. A projecting lug or equivalent 175 on the base twist locks into a mating portion of the housing 20.

Figure 4B:
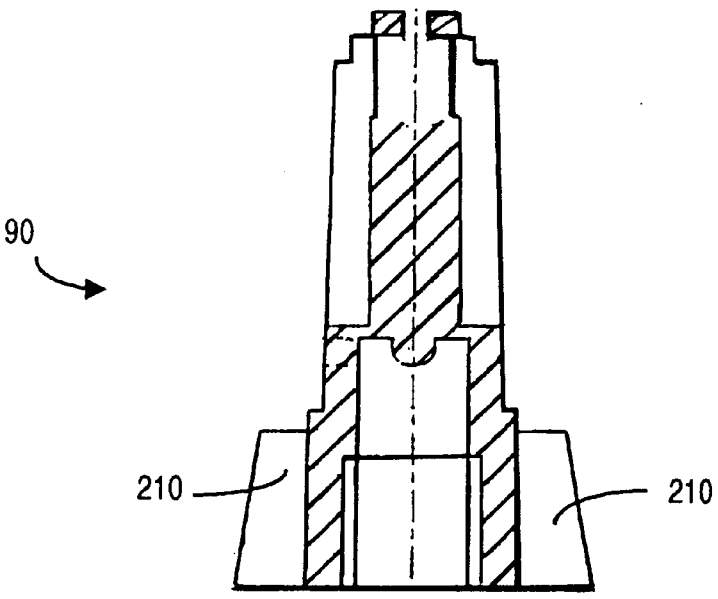
FIG. 4B is a second partial cutaway view depicting an impeller member, according to the present invention.
Figure 4A:
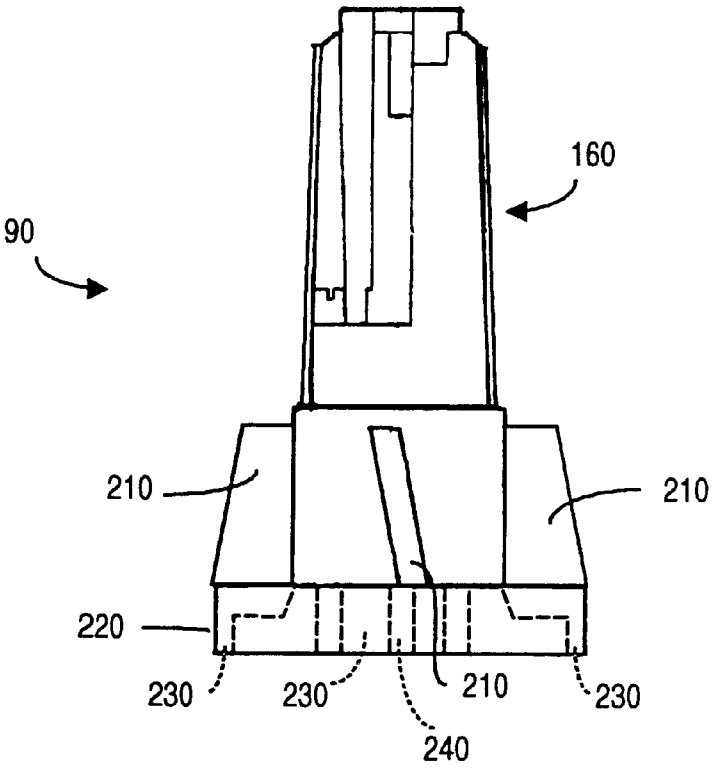
FIG. 4A is a partial cutaway view depicting an impeller member, according to the present invention.

FIG. 4A and FIG. 4B are partial cut-away views of impeller finned member 90. A periphery portion of member 90 includes a number of impeller fins 210, whose fin axes are inclined relative to an axial, e.g., vertical, axis of member 90. A lower portion of member 90 includes projections 220 that preferably mate with openings 230 in a base portion 240 that is rotatable by motor 70. For example, a shaft-like opening 250 can mate with a rotatable element of motor 70. The upper portion 260 of member 90 preferably fits within and engages blade cutting head assembly 30, such that blade set 150 is rotated upon rotation of motor 70. Of course other mechanisms for coupling rotational energy from motor 70 to member 90 and to blade assembly 50 may instead be used. For example, a single pump vane or fin that spirals 360° around a central hub may be used to advantage.

Use of groomer 10 is straightforward. The user removes protective cap 50 and inserts the distal end of cutting head assembly 30 into an ear or nostril, from which hairs are to be cut. Depressing switch 60 turns-on light source 110, which aids the user in batter directing the cutting head assembly against the hairs in question. Switch 60 also turns-on motor 70. If desired, switch 60 could of course first turn-on light source 110 and then turn-on motor 70. Switch 60 may be implemented in several ways. Switch 60 may be "on" only while being depressed by a user, e.g., switch contacts are closed only while the switch is being depressed. Alternatively, switch 60 may be implemented with a toggling action, such that momentary user pressure turns on switch "on", and a subsequent momentary user pressure turns the switch "off". In this latter embodiment it is unnecessary for the user to constantly apply pressure to switch 60 while using the present invention, thus promoting convenience of use of the invention.

The energized motor rotates blade assembly 150, and the cutting edges of blades 170 cut the hair in question against the castellation-like inwardly curving projections on stationary member 160. The motor also rotates impeller blades 210, which do not significantly slow motor rotation, as there is relatively little friction against the ambient air.

Cleaning groomer 10 is substantially easier than in the prior art. The distal end of groomer 10 is inserted into a receptacle of water, a glass perhaps, and switch 60 is turned-on. Impeller blades 210 (or, alternatively, single spiral vane) now draw water from the receptacle, into the cutting head assembly 30, into the space within member 40, and out through sidewall vents 130. The relative area, shape, and orientation of vents 130 compared to the volume defined by member 40 preferably produce a turbulent water flow action that vigorously washes away cut hairs, dust, and any other debris from the groomer. As such, groomer 10 rapidly self-cleans, without need for disassembly, or the user of tools other than water. Groomer 10 preferably is sufficiently water tight that, if necessary, the entire groomer could be operated under water without damaging the motor, battery, or switch.

Modifications and variations may be made to the disclosed embodiments without departing from the subject and spirit of the invention as defined by the following claims.

What is claimed is:

1. A personal groomer for trimming nose and/or ear hairs, comprising:

a hand-holdable housing;

a cutting head assembly, disposed within and protruding at least partially from a distal end of said housing, including a rotatable inner blade unit and a concentric outer stationary cutting unit, said inner blade unit including a rotatable base member from which there protrudes at least one impeller fin inclined relative to an axis of rotation of said rotatable inner blade unit; and a motor, disposed within said housing so as to rotate, when energized, said rotatable inner blade unit, wherein when said cutting head assembly is immersed in water and said motor is energized, impeller fin rotation draws water into said cutting head assembly for cleaning.

2. The personal groomer of claim 1, further including a light source, disposed within said housing so as to provide, when energized, illumination generally directed towards said hairs.

3. The personal groomer of claim 1, further including a generally thimble-shaped member having sidewalls defining a plurality of through-vents, and having an upper surface defining an opening sized to admit a protruding portion of said cutting head assembly;

wherein said thimble-shaped member is disposed in said housing surrounding at least a lower portion of said cutting head assembly, a distal portion of said cutting head assembly protruding through said opening.

4. The personal groomer of claim 3, wherein said thimble-shaped member is disposed to surround said impeller fin such that when said motor is energized and said cutting head assembly is immersed in water, water is expelled by said impeller fin through at least one of said through-vents.

5. The personal groomer of claim 1, wherein said rotatable inner blade unit includes at least two blades protruding therefrom, each of said blades forming approximately a 90° bend adjacent a distal blade end.

6. The personal groomer of claim 5, wherein at least one of said blades is fabricated from a material selected from a group consisting of (a) ceramic, (b) metal, and (c) stainless steel.

7. The personal groomer of claim 1, wherein said concentric outer stationary cutting unit defines a plurality of partially inwardly-inclined castellations.

8. The personal groomer of claim 1, further including a user operable switch, attached to said housing, electrically coupled to permit user energization of said personal groomer.

9. A personal groomer for trimming nose and/or ear hairs, comprising:

a hand-holdable housing;

a cutting head assembly, disposed within and protruding at least partially from a distal end of said housing, including a rotatable inner blade unit and a concentric outer stationary cutting unit;

a motor, disposed within and operable within said housing so as to rotate, when energized, said rotatable inner blade; and an impeller fin member, disposed adjacent a lower portion of said cutting head assembly for rotational motion thereabout, said impeller fin member being disposed so as to draw water into said cutting head assembly when said cutting head assembly is immersed in water and said motor is energized.

10. The personal groomer of claim 9, further including a light source, disposed within said housing so as to provide, when energized, illumination generally directed towards said hairs.

11. The personal groomer of claim 9, further including a generally thimble-shaped member having sidewalls defining a plurality of through-vents, and having an upper surface defining a through hole sized to admit a protruding portion of said cutting head assembly;

wherein said thimble-shaped member is disposed in said housing surrounding at least a lower portion of said cutting head assembly, a distal portion of said cutting head assembly protruding through said through hole.

12. The personal groomer of claim 9, further including a generally thimble-shaped member having sidewalls defining a plurality of through-vents, and having an upper surface defining an opening sized to admit a protruding portion of said cutting head assembly;

wherein said thimble-shaped member is disposed in said housing surrounding at least a lower portion of said cutting head assembly and surrounding said impeller fin member, a distal portion of said cutting head assembly protruding through said opening; and wherein when said motor is energized and said cutting head assembly is immersed in water, water is expelled by said fins through at least one of said vents.

13. The personal groomer of claim 9, wherein said rotatable inner blade unit includes at least two blades protruding therefrom, each of said blades forming approximately a 90° bend adjacent a distal blade end.

14. The personal groomer of claim 13, wherein at least one of said blades is fabricated from a material selected from a group consisting of (a) ceramic, (b) metal, and (c) stainless steel.

15. The personal groomer of claim 10, wherein said concentric outer stationary cutting unit defines a plurality of partially inwardly-inclined castellations.

16. A personal groomer for trimming nose and/or ear hairs, comprising:

a hand-holdable housing;

a cutting head assembly, disposed within and protruding at least partially from a distal end of said housing, including a rotatable inner blade unit and a concentric outer stationary cutting unit;

said rotatable inner blade unit including a rotatable base member and at least two blades protruding therefrom, each of said blades forming approximately a 90° bend adjacent a distal blade end;

said concentric outer stationary cutting unit defining a plurality of partially inwardly-inclined castellations;

a motor, disposed within and operable within said housing so as to rotate, when energized, said rotatable inner blade;

an impeller fin member, disposed adjacent a lower portion of said cutting head assembly for rotational motion thereabout;

said impeller fin member including at least one fin disposed so as to draw water into said cutting head assembly when said cutting head assembly is immersed in water and said motor is energized; and a light source, disposed within said housing so as to provide, when energized, illumination generally directed towards said hairs.

17. The personal groomer of claim 16, further including a generally thimble-shaped member having sidewalls defining a plurality of through-vents, and having an upper surface defining a through hole sized to admit a protruding portion of said cutting head assembly;

wherein said thimble-shaped member is disposed in said housing surrounding at least a lower portion of said cutting head assembly, a distal portion of said cutting head assembly protruding through said through hole; and wherein when said motor is energized and said cutting head assembly is immersed in water, water is expelled by said at least one fin through at least one of said vents.

18. The personal groomer of claim 17, further including a user operable switch, attached to said housing, electrically coupled to permit user energization of said personal groomer.

19. A method of cleaning a personal groomer of the type having a hand-holdable housing within which is disposed a cutting head assembly that protrudes at least partially from a distal end of said housing, and a motor coupled to rotate, when energized, at least a portion of said cutting head assembly so as to cut hairs, the method including the following steps:

disposing an impeller fin member adjacent a lower portion of said cutting head assembly for rotational motion thereabout when said motor is energized, said impeller fin member including at least one fin;

submerging at least the protruding portion of said cutting head assembly in water; and energizing said motor;

wherein at least some of said water is drawn into said cutting head assembly and is expelled therefrom by rotation of said at least one impeller fin, and said cutting head assembly is cleaned.

20. The personal groomer of claim 9, wherein said impeller fin member includes at least one fin inclined relative to an axis of rotation of said rotatable inner blade unit.

21. The personal groomer of claim 9, wherein said impeller fin member includes a spiralled pump vane fin.

22. The personal groomer of claim 21, wherein said spiralled pump vane fin spirals 360°.

* * * * *